US008443743B2

(12) United States Patent
Christman, Jr.

(10) Patent No.: US 8,443,743 B2
(45) Date of Patent: May 21, 2013

(54) SYSTEM AND METHOD FOR CONTROL OF YARN FEED IN A TUFTING MACHINE

(75) Inventor: William M. Christman, Jr., Chattanooga, TN (US)

(73) Assignee: Card-Monroe Corp., Chattanooga (Hixson), TN (US)

( * ) Notice: Subject to any disclaimer, the term of this patent is extended or adjusted under 35 U.S.C. 154(b) by 1229 days.

(21) Appl. No.: 12/256,788

(22) Filed: Oct. 23, 2008

(65) Prior Publication Data

US 2009/0101051 A1 Apr. 23, 2009

Related U.S. Application Data

(60) Provisional application No. 60/981,994, filed on Oct. 23, 2007.

(51) Int. Cl.
*D05C 15/26* (2006.01)

(52) U.S. Cl.
USPC ..... 112/80.23; 112/80.01; 112/470.01; 700/136

(58) Field of Classification Search
USPC ..... 112/80.01, 80.23, 80.3, 80.32, 80.5, 112/80.54, 80.55, 470.01; 700/136, 137
See application file for complete search history.

(56) References Cited

U.S. PATENT DOCUMENTS

| | | | |
|---|---|---|---|
| 2,990,792 | A | 7/1961 | Nowicki et al. |
| 3,375,797 | A | 4/1968 | Gaines |
| 3,485,195 | A | 12/1969 | Torrence |
| 3,618,542 | A | 11/1971 | Zocher |
| 3,709,173 | A | 1/1973 | Greene |
| 3,757,709 | A | 9/1973 | Cobble |
| 3,835,797 | A | 9/1974 | Franks et al. |
| 3,847,098 | A | 11/1974 | Hammel, Jr. |
| 3,919,953 | A | 11/1975 | Card et al. |
| 3,943,865 | A | 3/1976 | Short et al. |
| 4,103,629 | A | 8/1978 | Card |
| 4,106,416 | A | 8/1978 | Blackstone, Jr. et al. |
| 4,134,348 | A | 1/1979 | Scott |
| 4,138,956 | A | 2/1979 | Parsons |
| 4,155,319 | A | 5/1979 | Short |
| 4,170,949 | A | 10/1979 | Lund |
| 4,185,569 | A | 1/1980 | Inman |

(Continued)

FOREIGN PATENT DOCUMENTS

| | | | |
|---|---|---|---|
| GB | 2050447 | A | 1/1981 |
| GB | 2115025 | A | 9/1983 |

(Continued)

OTHER PUBLICATIONS

Search report for related application, PCT International Search Report, application No. PCT/US2008/080946, filed Oct. 23, 2008.

(Continued)

*Primary Examiner* — Nathan Durham
(74) *Attorney, Agent, or Firm* — Womble Carlyle Sandridge & Rice LLP

(57) ABSTRACT

A system and method for controlling the yarn feed for a tufting machine to form tufted patterns having different pattern fields or areas. Predetermined yarn feed amounts can be input for one or more selected yarn feed zones of selected stitches of the pattern to enable different pile heights and/or different tufts of yarns to be formed in the different pattern zones. A yarn feed device for the tufting machine will be controlled to selectively feed varying amounts of yarns for each of the yarn feed zones of the selected stitches of the pattern.

14 Claims, 4 Drawing Sheets

U.S. PATENT DOCUMENTS

| | | | |
|---|---|---|---|
| 4,193,358 | A | 3/1980 | Woodcock |
| 4,195,580 | A | 4/1980 | Hurst |
| 4,313,388 | A | 2/1982 | Biggs et al. |
| 4,353,317 | A | 10/1982 | Crumbliss |
| 4,366,761 | A | 1/1983 | Card |
| 4,369,720 | A | 1/1983 | Beasley |
| 4,393,793 | A | 7/1983 | Beasley |
| 4,397,249 | A | 8/1983 | Slattery |
| 4,419,944 | A | 12/1983 | Passons et al. |
| 4,440,102 | A | 4/1984 | Card et al. |
| 4,466,366 | A | 8/1984 | Hirotsu |
| 4,522,132 | A | 6/1985 | Slattery |
| 4,549,496 | A | 10/1985 | Kile |
| 4,557,208 | A | 12/1985 | Ingram et al. |
| 4,574,716 | A | 3/1986 | Czelusniak, Jr. |
| 4,619,212 | A | 10/1986 | Card et al. |
| 4,630,558 | A | 12/1986 | Card et al. |
| 4,637,329 | A | 1/1987 | Czelusniak, Jr. |
| 4,667,611 | A | 5/1987 | Yamamoto et al. |
| 4,688,497 | A | 8/1987 | Card et al. |
| 4,815,403 | A | 3/1989 | Card et al. |
| 4,836,118 | A | 6/1989 | Card et al. |
| 4,841,886 | A | 6/1989 | Watkins |
| 4,849,270 | A | 7/1989 | Evans et al. |
| 4,856,441 | A | 8/1989 | Kurata |
| 4,860,674 | A | 8/1989 | Slattery |
| 4,864,946 | A | 9/1989 | Watkins |
| 4,867,080 | A | 9/1989 | Taylor et al. |
| 4,903,624 | A | 2/1990 | Card et al. |
| 4,903,625 | A | 2/1990 | Card et al. |
| 4,981,091 | A | 1/1991 | Taylor et al. |
| 4,991,523 | A | 2/1991 | Ingram |
| 5,005,498 | A | 4/1991 | Taylor et al. |
| 5,058,518 | A | 10/1991 | Card et al. |
| 5,080,028 | A | 1/1992 | Ingram |
| 5,094,178 | A | 3/1992 | Watkins |
| 5,158,027 | A | 10/1992 | Ingram |
| 5,165,352 | A | 11/1992 | Ingram |
| 5,182,997 | A | 2/1993 | Bardsley |
| 5,224,434 | A | 7/1993 | Card et al. |
| 5,383,415 | A | 1/1995 | Padgett, III |
| 5,458,075 | A | 10/1995 | Tice et al. |
| 5,461,996 | A | 10/1995 | Kaju |
| 5,501,250 | A | 3/1996 | Edwards et al. |
| 5,526,760 | A | 6/1996 | Ok |
| 5,544,605 | A | 8/1996 | Frost |
| 5,549,064 | A | 8/1996 | Padgett, III |
| 5,575,228 | A | 11/1996 | Padgett et al. |
| 5,588,383 | A | 12/1996 | Davis et al. |
| 5,622,126 | A | 4/1997 | Card et al. |
| 5,662,054 | A | 9/1997 | Bardsley |
| 5,738,030 | A | 4/1998 | Ok |
| 5,743,201 | A | 4/1998 | Card et al. |
| 5,794,551 | A | 8/1998 | Morrison et al. |
| 5,806,446 | A | 9/1998 | Morrison et al. |
| 5,899,152 | A | 5/1999 | Bardsley et al. |
| 5,954,003 | A | 9/1999 | Beyer et al. |
| 5,983,815 | A | 11/1999 | Card |
| 6,009,818 | A | 1/2000 | Card et al. |
| 6,155,187 | A | 12/2000 | Bennett et al. |
| 6,196,145 | B1 | 3/2001 | Burgess |
| 6,202,580 | B1 | 3/2001 | Samilo |
| 6,244,203 | B1 | 6/2001 | Morgante et al. |
| 6,263,811 | B1 | 7/2001 | Crossley |
| 6,273,011 | B1 | 8/2001 | Amos |
| 6,283,053 | B1 | 9/2001 | Morgante et al. |
| 6,293,211 | B1 | 9/2001 | Samilo |
| 6,401,639 | B1 | 6/2002 | Samilo |
| 6,439,141 | B2 | 8/2002 | Morgante et al. |
| 6,446,566 | B1 | 9/2002 | Bennett et al. |
| 6,502,521 | B2 | 1/2003 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,758,154 | B2 | 7/2004 | Johnston |
| 6,807,917 | B1 | 10/2004 | Christman et al. |
| 6,834,601 | B2 | 12/2004 | Card et al. |
| 6,834,602 | B1 | 12/2004 | Hall |
| 6,877,447 | B2 | 4/2005 | Frost et al. |
| 6,877,449 | B2 | 4/2005 | Morgante et al. |
| 6,945,184 | B2 | 9/2005 | Frost et al. |
| 6,971,326 | B1 | 12/2005 | Clarke et al. |
| 7,089,874 | B2 | 8/2006 | Morgante et al. |
| 7,096,806 | B2 | 8/2006 | Card et al. |
| 7,130,711 | B2 | 10/2006 | Dabrowa et al. |
| 7,216,598 | B1 | 5/2007 | Christman, Jr. |
| 7,296,524 | B2 | 11/2007 | Beverly |
| 7,347,151 | B1 | 3/2008 | Johnston et al. |
| RE40,194 | E | 4/2008 | Slattery |
| 7,350,443 | B2 | 4/2008 | Oakey et al. |
| 7,356,453 | B2 | 4/2008 | Gould |
| 7,426,895 | B2 | 9/2008 | Smith et al. |
| 7,431,974 | B2 | 10/2008 | Lovelady et al. |
| 7,490,566 | B2 | 2/2009 | Hall |
| 7,490,569 | B2 | 2/2009 | Whitten et al. |
| 7,634,326 | B2 | 12/2009 | Christman, Jr. et al. |
| 2002/0037388 | A1 | 3/2002 | Morgante et al. |
| 2003/0164130 | A1 | 9/2003 | Morgante et al. |
| 2004/0025767 | A1 | 2/2004 | Card et al. |
| 2004/0187268 | A1 | 9/2004 | Johnston |
| 2004/0253409 | A1 | 12/2004 | Whitten et al. |
| 2005/0056197 | A1 | 3/2005 | Card et al. |
| 2005/0204975 | A1 | 9/2005 | Card et al. |
| 2006/0272564 | A1 | 12/2006 | Card et al. |
| 2007/0272137 | A1 | 11/2007 | Christman et al. |
| 2008/0134949 | A1 | 6/2008 | Bearden |

FOREIGN PATENT DOCUMENTS

| | | | |
|---|---|---|---|
| GB | 2446371 | A | 1/1992 |
| GB | 2319786 | A | 6/1998 |
| GB | 2392172 | A | 2/2004 |
| WO | WO84/00388 | | 2/1984 |
| WO | WO94/28225 | | 5/1994 |
| WO | WO96/12843 | | 5/1996 |
| WO | WO01/59195 | | 8/2001 |
| WO | WO2004/057084 | | 7/2004 |

OTHER PUBLICATIONS

Related application, No. WO 96/12843, publication date May 2, 1996.

Related application, No. WO 2004/057084, publication date Jul. 8, 2004.

CAN with Encore DMC, Operator's Manual, Version 3.6, Tuftco Corporation, Copyright 1995, Chattanooga, TN.

Command Performance 200 Instruction Manual, Version 3.12, CMC #801107-01, Card-Monroe Corp., Copyright 1985-1994, Chattanooga, TN.

Tuft Program, Version 1.20, Nov. 1993, NedGraphics BV.

CMC Yarntronics Brochure, http://www.cardmonroe.com/Products/Yarntronics/yarnt.htm, printed Feb. 21, 2002.

Automation Comes to Paris, Carpet & Rug, Inc., 1987.

Moving Toward Total Automation, Carpet & Rug Industry, Dec. 1990.

Notice of Opposition to European Patent EP2220278, filed by Cobble Blackburn Limited on Feb. 6, 2012.

ST (with Graphical User Interface) Tufting Machine Operator's Handbook, Revision 1.5, Software build 43, Sep. 2003, Cobble Blackburn Limited, Blackburn, England.

Servo Systems Operation Manual, New Software Version, Issue 2.IIA, Apr. 1999, Cobble Blackburn Limited, Blackburn, England.

Response to Notice of Opposition to European Patent EP2220278, filed by Card Monroe Corporation on Jul. 5, 2012.

Written Opinion in PCT/US2008/080946, issued Jun. 5, 2010.

Response to Written Opinion filed in European Patent Application 08 841 794.4 on Aug. 5, 2010.

SYSTEM AND METHOD FOR CONTROL OF YARN FEED IN A TUFTING MACHINE

CROSS REFERENCE TO RELATED APPLICATION

The present patent application is a formalization of previously filed, co-pending U.S. Provisional Patent Application No. 60/981,994, filed Oct. 23, 2007 by the inventor named in the present Application. This Patent Application claims the benefit of the filing date of this cited Provisional Patent Application according to the statutes and rules governing provisional patent applications, particularly 35 U.S.C. §119(a)(i) and 36 C.F.R. §1.78(a)(4) and (a)((5). The specification and drawings of the Provisional Patent Application referenced above are specifically incorporated herein by reference as if set forth in their entirety.

FIELD OF THE INVENTION

This invention generally relates to the tufting of fabrics, and in particular to a method and system for controlling the feeding of yarns in the tufting machine to form tufted fabrics or products.

BACKGROUND OF THE INVENTION

In the tufting of carpets and other, similar products, it is known to form patterns utilizing different colors and/or different pile tufts, including the formation of loop pile and cut pile tufts in a backing material. For example, U.S. Pat. No. 3,919,953 discloses an apparatus and method for tufting spaced rows of loop pile tufts and cut pile tufts in a backing material using a multi-needle tufting machine having spaced, transverse rows of needles that cooperate with loop pile loopers or cut pile hooks mounted therebelow, along the upstream and downstream sides of the tufting machine. It additionally has been known to form sculpted or similar tufted patterns having different pile heights of tufts formed in the backing materials in order to form different looks or patterns. Still further, tufting techniques have been adapted for use in forming artificial synthetic turf fabrics, which can include a series of different pile height tufts of the synthetic grass yarns in order to provide for desired fill, ball bounce, roll, etc., for such artificial grass or turf fabrics.

It further can be seen that a continuing need exists for a system and method for controlling the yarn feeds in a tufting machine to form patterned carpets having enhanced pattern effects that addresses the foregoing related and unrelated problems and features in the art.

SUMMARY OF THE INVENTION

Briefly described, the present invention generally relates to a yarn feed indexing or profile control system for controlling the feeding of a series of yarns to one or more of the needles of a tufting machine, with the yarns being maintained under a substantially constant tension. The feeding of the yarns to each needle during formation of each stitch being formed can be variably controlled by the yarn feed control system of the present invention to provide enhanced precision and pattern yarn feed profile control as needed or desired to form the tufts of yarn in a backing material being passed through the tufting machine according to desired or programmed pattern instructions. Each stitch can be divided into yarn feed or stitch zones that correspond to a portion or segment of a tufting cycle for forming the stitch, such as being selected as a portion or segment of at least one revolution of the main shaft for forming the stitch.

The yarn feed control system of the present invention is generally adapted to control a yarn feed attachment, such as a roll, scroll, single end, double end, and yarn feed pattern attachment such as a Card-Monroe Corp. Infinity™ or Infinity IIE™ system, a Yarntronics™ attachment, or other pattern yarn feed control systems or mechanisms adapted to variably control the feeding of one or more yarns to the needles of the tufting machine as needed during the formation of each or selected stitches of the pattern. It will, however, be understood by those skilled in the art that various other types of yarn feed systems or attachments also can be used with the present invention, including yarn feed systems for feeding multiple (i.e., two or more) yarns to the needles of the tufting machine, and including the use of tube banks. The needles of the tufting machine can be arranged in spaced series along one or more needle bars and are reciprocated into and out of the backing material passing thereabout to form loop and/or cut pile tufts therein.

The yarn feed control system of the present invention generally will include a system controller that also can be utilized for monitoring and controlling other operations or functions of the tufting machine, such as the driving of the needle bars and the feeding of the backing material through the tufting machine, and monitoring revolution of the main shaft of the tufting machine. The system controller generally will be in communication with a series of yarn feed controllers for one or more yarn feed motors of the yarn feed attachment, for controlling the operation of the yarn feed motors as needed to provide a desired yarn feed profile or indexing to create selected yarn feed patterns or pile heights within the tufted fabric. The yarn feed controllers will receive their instructions from the system controller, and in turn will communicate with the motors for controlling the feeding of the yarns to the desired needles or groups of needles of each of the prescribed stitch or yarn feed zones of each stitch being formed in the tufted fabric to form the desired patterns and/or pile heights.

The system controller can be provided as a separate workstation having an input mechanism such as a keyboard, mouse, monitor, etc., and can be in direct control of the tufting machine, or can be in communication with a tufting machine control that monitors and controls the operative elements of the tufting machine. In addition, the system controller can be connected to a design center so that an operator can design a desired pattern for the finished tufted fabric or carpet. The design center generally includes a computer that can calculate the parameters of such a design, including parameters such as yarn feed rates, pile heights, stitch length, etc. for each of the programmed pattern stitches and yarn feed zones thereof. This information can be created as a pattern data file designed or programmed using pattern design software, and can be input or electronically communicated to the tufting machine controller and/or system controller via a network connection, disk, or other file transfer means. Such design center functionality also can be provided within the system controller for the yarn feed control system of the present invention.

In operation, an operator will select at least one yarn feed zone for one or more of the pattern steps or stitches to be formed, and will input a desired yarn feed amount for the selected yarn feed zone of such stitch pattern step. The remaining yarn feed amounts can then be assigned to one or more remaining yarn feed zones of the selected stitch or pattern step, either by operator input or automatically by the system controller. The tufting machine then will be operated to tuft the desired or programmed pattern steps, including feeding the input yarn feed amounts for the selected yarn feed zone(s) during formation of each pattern stitch or step, and thereafter feeding the calculated yarn feed amount(s) for the remaining yarn feed zone(s) until the pattern run is completed. The process will be repeated for each stitch or step in the pattern, or alternatively, the system controller can assign the programmed yarn feed profiles to all or additional selected stitches or steps of the pattern as needed or desired.

Various objects, features and advantages of the present invention will become apparent to those skilled in the art upon a review of the following Detailed Description, when taken in conjunction with the accompanying drawings.

DETAILED DESCRIPTION

Figure 1A:
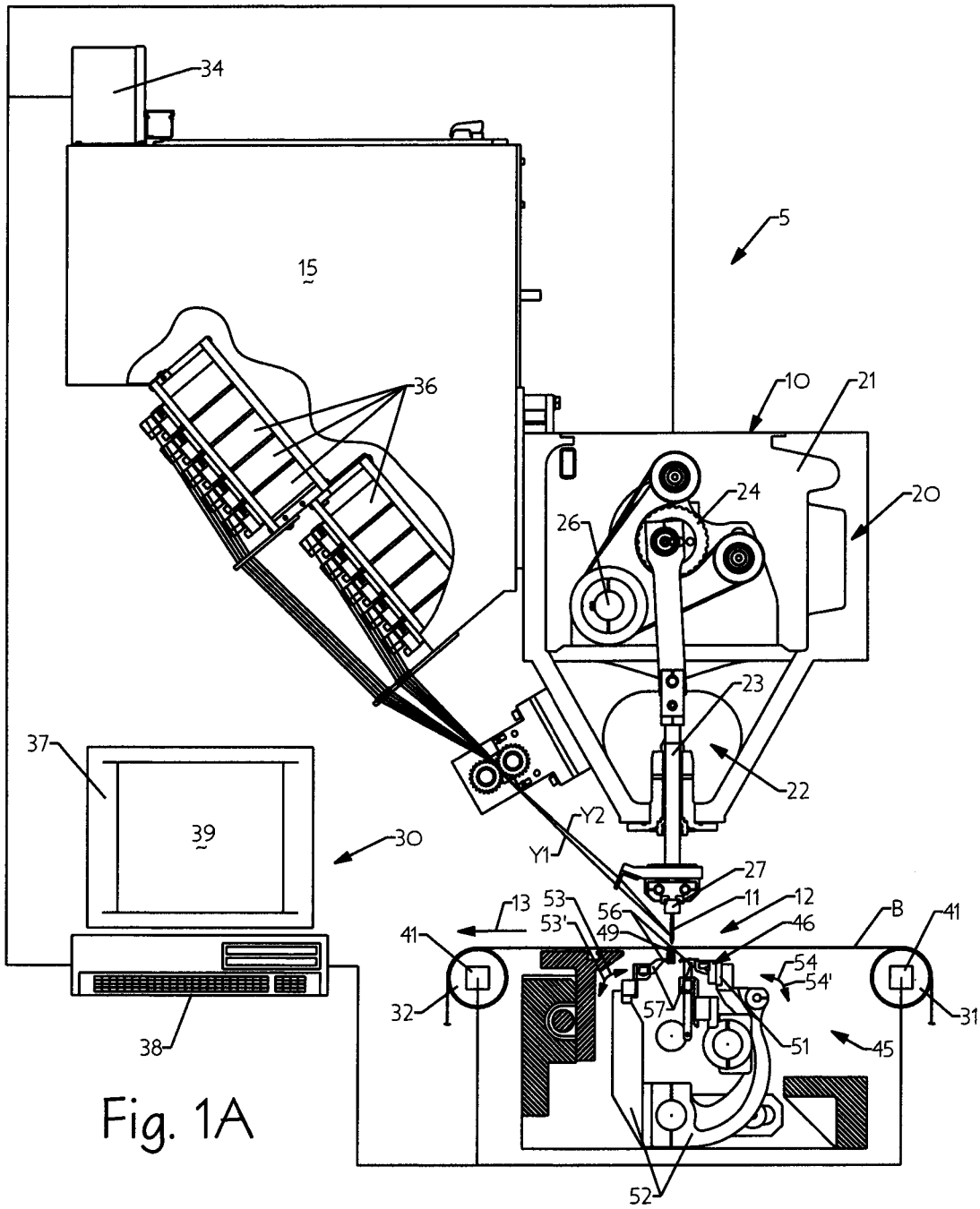
FIG. 1A is a side elevational view of one example embodiment tufting machine incorporating the yarn feed control system according to the principles of the present invention.
Figure 1B:
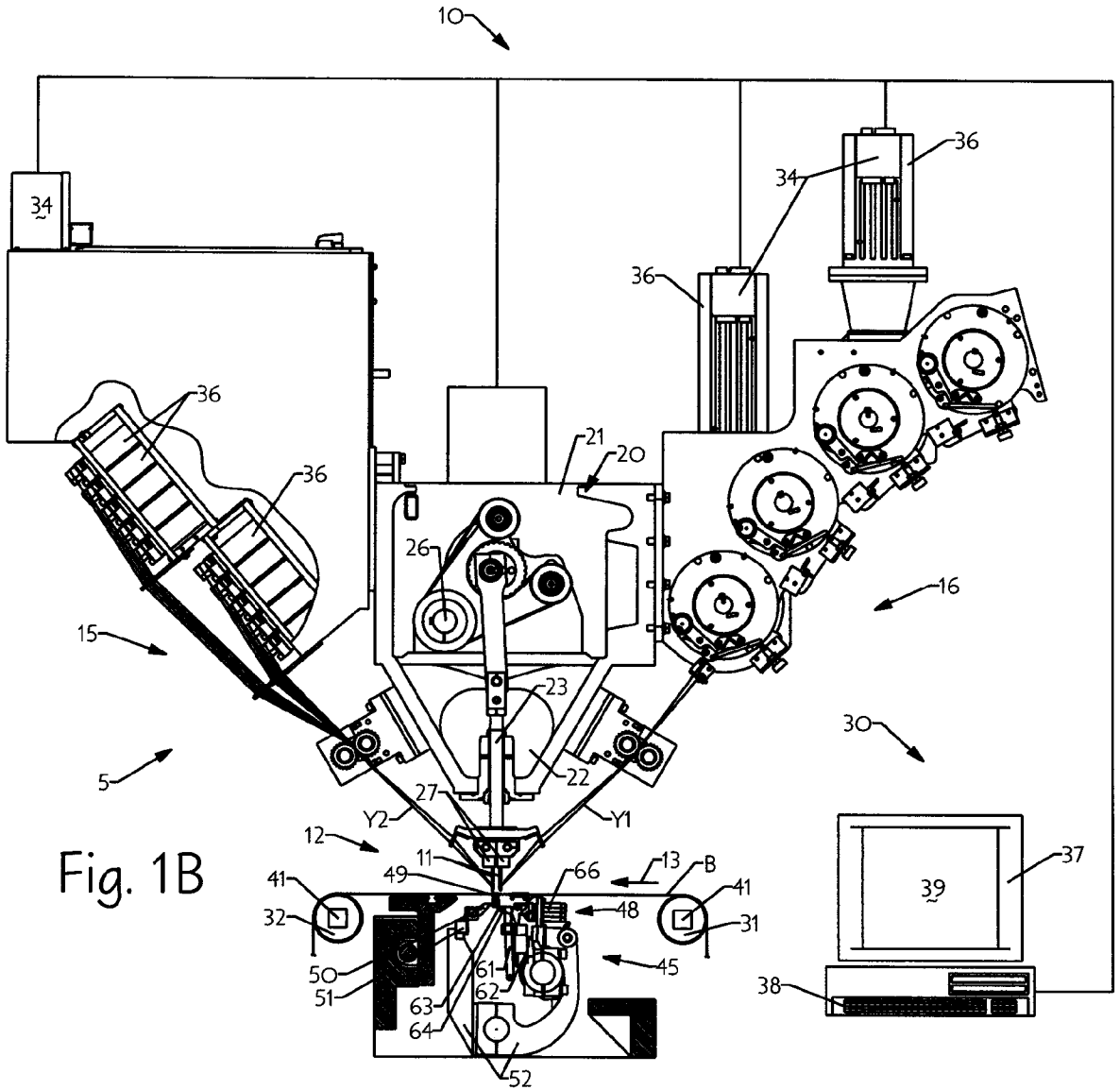
FIG. 1B is a side elevational view of another example embodiment of a tufting machine incorporating the yarn feed control system of the present invention, further illustrating the use of different yarn feed devices.
Figure 3:
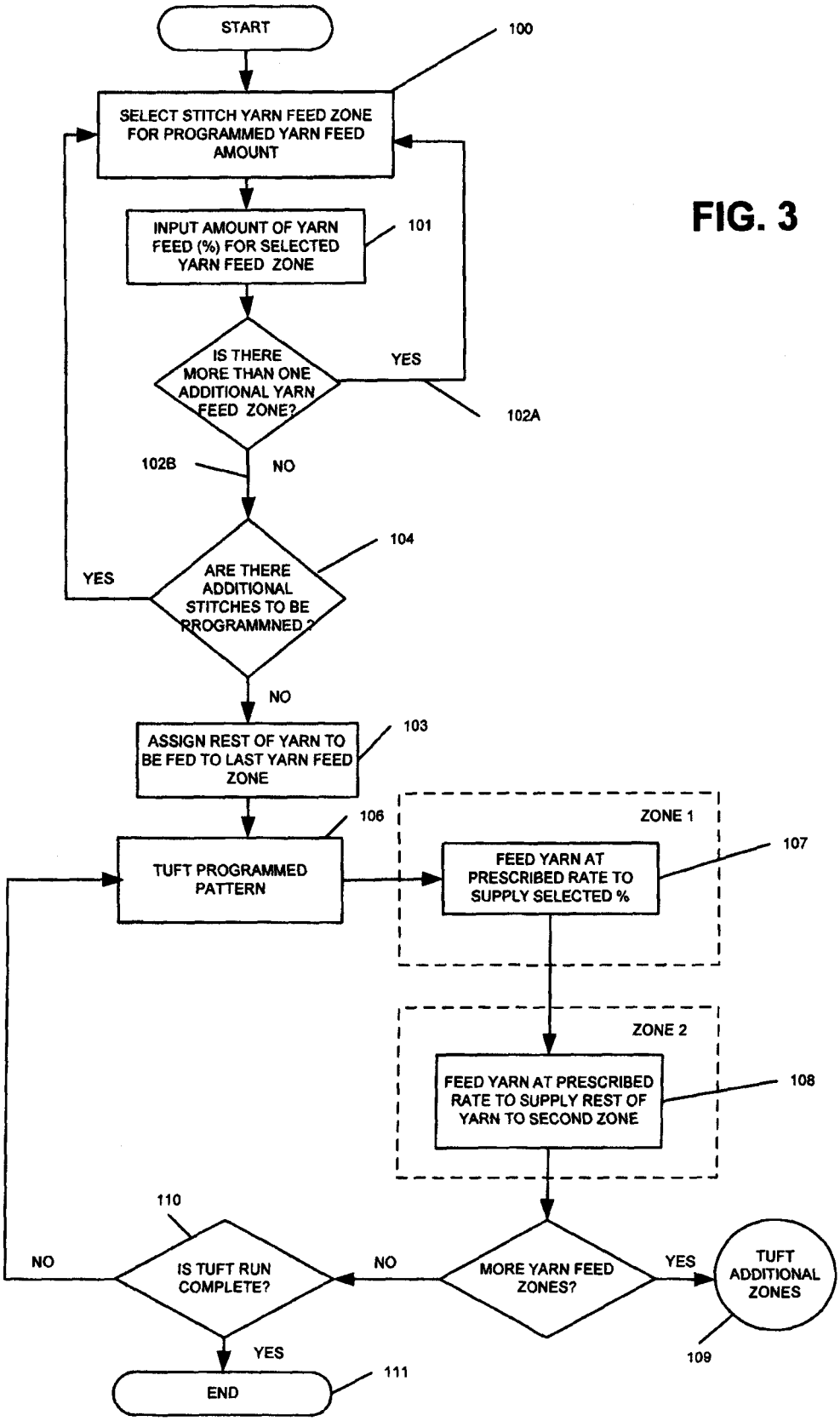
FIG. 3 is a flow chart schematically illustrating the yarn feed control system and method according to the present invention.

Referring now to the drawings in greater detail in which like numerals indicate like parts throughout the several views, FIGS. 1A-1B illustrate a yarn feed control system 5 and FIG. 3 generally illustrates a method of operation of a yarn feed indexing or yarn feed profile control system according to the principles of the present invention, for the control of the feeding of a series of yarns Y1-Y2 in a tufting machine 10 for forming patterned tufted articles, such as carpets and the like. The yarn feed control system 5 (FIGS. 1A-1B) controls the feeding of the yarns Y1-Y2 to associated needles 11 of the tufting machine 10, with the yarns generally being maintained under substantially constant tension as they are fed to their needles so as to help provide enhanced precision and increased pattern yarn feed profile control as needed or desired to form stitches or tufts of yarns in a backing material B being fed through a tufting zone 12 or area of the tufting machine 10, as indicated by arrow 13, according to desired or programmed yarn feed profile or pattern instructions.

In operation, the yarn feed control system 5 (FIG. 1A) of the present invention generally is adapted to control one or more yarn feed attachments 15, such as a roll, scroll, single end, double end, or other yarn feed pattern attachments. Such yarn feed pattern attachments can include a Card-Monroe Corp. Infinity™ or Infinity IIE™ system, a QuickThread™ attachment, a Yarntronics™ attachment, or various other pattern yarn feed control systems, mechanisms or devices that are adapted to control the feeding of one or more yarns Y1-Y2 to one or more needles 11 of the tufting machine 10. FIG. 1A generally illustrates the use of an Infinity™ type single/double end yarn feed control system or attachment 15, such as manufactured by Card-Monroe Corp., mounted on one side of the tufting machine 10. Alternatively, FIG. 1B shows the use of an Infinity™ type single/double end yarn feed control system or attachment 15 on one side of the tufting machine, with a scroll or roll type yarn feed control or pattern attachment 16 mounted on an opposite side of the tufting machine. It further will be understood by those skilled in the art that various other types of yarn feed systems or attachments also can be used with the present invention, including yarn feed systems for feeding multiple (i.e., two or more) yarns to the needles, and including the use of tube banks. For example, U.S. Pat. Nos. 6,009,818; and 5,983,815; and 7,096,806, assigned to Card-Monroe Corp., disclose pattern yarn feed mechanisms or attachments for controlling feeding or distribution of yarns to the needles of a tufting machine. U.S. Pat. No. 5,979,344 further discloses a precision drive system for driving various operative elements of a tufting machine. All of these systems can be utilized with the present invention and are incorporated herein by reference as if set forth fully in their entireties.

Figure 2:
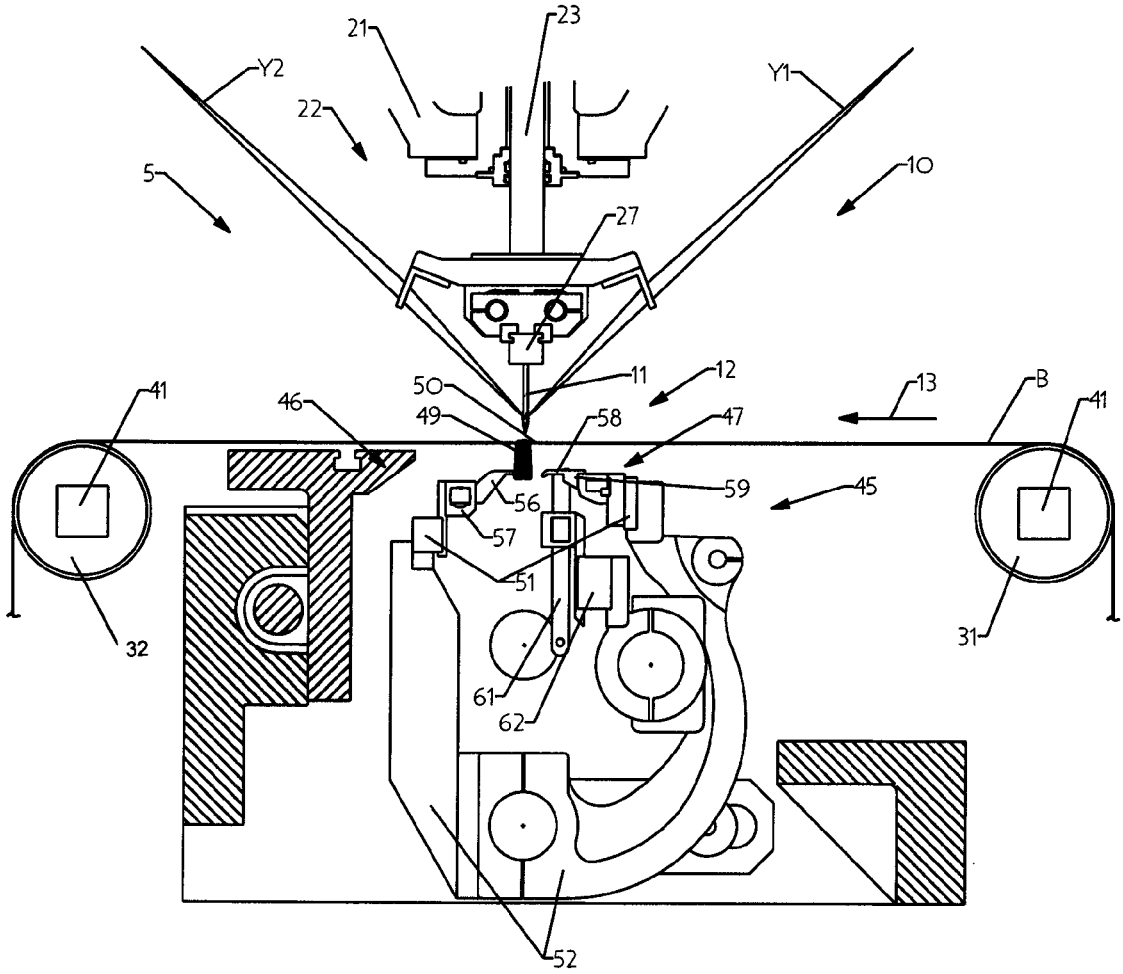
FIG. 2 is a side elevational view of the tufting zone of a tufting machine.

As generally illustrated in FIGS. 1A and 1B, the tufting machine 10 typically includes a frame 20 including an upper or head portion 21 housing a needle bar drive mechanism 22 and defining the tufting zone 12, and to which the yarn feed attachment 15 (FIG. 1A) or attachments 15/16 (FIG. 1B) generally are mounted. The needle bar drive mechanism 22 generally includes a series of push rods 23 connected to a gear box or similar mechanism 24, which in turn is connected to and driven off of a main drive shaft 26 of the tufting machine. The push rods 23 generally will carry one or more needle bars 27 along which the needles 11 are mounted in spaced series. As indicated in FIGS. 1A and 2, a single needle bar 27 can be used, with the needles 11 being arranged in a single row along the needle bar, or can be arranged in staggered series, spaced transversely from each other in two staggered rows. Alternatively, as indicated in FIG. 1B, a pair of needle bars 27 can be used, with spaced rows of needles mounted therealong. Additionally, the tufting machine 10 further can include a shifting mechanism for shifting the needle bar(s) 27 transversely across the tufting zone 12 as needed to form shifting or graphics type tufted patterns.

The yarn feed control system of the present invention further generally will include a system controller 30 that also can be utilized for monitoring and controlling other operations or functions of the tufting machine, such as monitoring the revolution and/or position of the main shaft, and driving the main shaft and thus the needle bar(s) of the tufting machine, as well as control of backing feed rolls 31/32, which feed the backing material B through the tufting zone 12, as indicated by arrow 33. The system controller 30 also generally will be in communication with a series of yarn feed controllers 34, which control one or more yarn feed motors 36 (FIG. 1A) of the yarn feed attachment 15 (or attachments 15 and 16 as indicated in FIG. 1B), for controlling operation of the yarn feed motors 36 as needed to provide a desired yarn feed profile or indexing of the selected yarn feed zones of each selected pattern step or stitch in order to create the programmed yarn feed patterns or pile heights across varying pattern fields or stitches of the tufted fabric article.

The yarn feed controllers 34 will receive their instructions from the system controller 30, and in turn communicate with the yarn feed motors 36 for controlling the feeding of the yarns Y1/Y2 to desired needles or groups of needles 11 forming each of the prescribed stitch zones of each pattern stitch of the tufted fabric article, in order to form the desired programmed pattern effects, such as differing pile heights, mixing of cut and loop pile tufts, forming of different visual effects, etc. An encoder additionally can be provided for monitoring the rotation of the main drive shaft 26 and can report the position of the main drive shaft to the system controller for control of the yarn feed during each yarn feed zone of the pattern stitch being run by the tufting machine.

The system controller 30 can be provided as a separate work station, as indicated at 37 in FIG. 1A, having an input mechanism such as a keyboard 38, mouse, or a monitor touch screen 39 to enable input of yarn feed amounts for each selected zone of each pattern stitch, as needed, and other pattern program parameters. The system controller 30 of the yarn feed control system of the present invention further can be in direct control of the tufting machine 10, and can comprise or be part of the overall tufting machine control system such as a "Command-Performance™" tufting machine control system as manufactured by Card-Monroe Corp., which system will further include a processor and/or memory for storing pattern information. Alternatively, the system controller can be in communication with a separate tufting machine control that monitors and controls the operative elements of the tufting machine.

In addition, the system controller also can be connected to a design center so that an operator can design a desired pattern for the finished tufted fabric article, such as a carpet, which design center generally will include a computer that can calculate parameters of the desired pattern design, including parameters such as yarn feed rates, pile heights, stitch lengths, etc., for each of the programmed pattern steps and/or the yarn feed zones thereof. This information can be created as a pattern data file designed or programmed using pattern design software, and/or can be input directly or electronically communicated to the tufting machine controller and/or system controller 30 such as via network connection, disk or other file transfer means. Such design center functionality, in which a desired pattern can be designed in its various parameters such as yarn feed rates, pile heights, stitch length, etc., also can be provided within the system controller 30 for the yarn feed control system of the present invention so as to enable the operator to directly design and/or input desired pattern parameters at the system control for controlling the entire tufting operation.

As further indicated in FIGS. 1A-2, the backing material B will be fed by backing feed rolls 31 and 32 through the tufting zone in a direction or feed path as indicated by arrow 33 by control of drive motors 41, typically under control of the system controller 30 and/or a tufting machine controller. The backing material B generally will be fed at a desired stitch rate for the pattern being formed. As additionally indicated in FIGS. 1A-2, a loop looper or hook assembly 45 generally will be mounted below the bed and tufting zone 12 of the tufting machine 10. The looper or hook assembly 45 generally can include loop pile loopers 46 (FIG. 1A), cut pile hooks 47 (FIG. 2), level cut loop loopers or hooks 48 (FIG. 1B), or various combinations thereof.

For example, as indicated in FIG. 1A, loop pile loopers 46 can be positioned on both the upstream and downstream sides of the tufting zone 12 for engaging the needles 11 to form loop pile tufts 49 on the backing material. Additionally, as indicated in FIG. 1B, loop pile loopers or cut pile hooks 48 can be utilized with level cut loop loopers or hooks, while FIG. 2 illustrates the use of loop pile loopers and cut pile hooks on opposite sides of the tufting zone, for forming both cut pile tufts 50 and loop pile tufts 49 of yarns in the backing material B. Each of the loop pile loopers 45 (FIG. 1A), cut pile hooks 47 (FIG. 2), and/or level cut loop loopers 48 (FIG. 1B) generally will be attached to a support block or holder 51 for a drive mechanism 52 that causes the loop pile loopers, cut pile hooks and/or level cut loop loopers to be driven in a reciprocating motion, in the direction of arrows 53/53' (FIG. 1A) and 54/54' as the needles penetrate the backing material so as to engage the needles and pick and pull loops of yarns therefrom. It also will be understood by those skilled in the art, however, that while particular arrangements of loop pile loopers, cut pile hooks and level cut loop loopers are illustrated in the attached drawings, various other configurations and/or arrangements of such gauge parts also can be utilized with the yarn feed control system of the present invention.

As further generally illustrated in FIGS. 1A and 2, each of the loop pile loopers 46 includes a forwardly extending bill or front portion 56, with a body 57 (FIG. 2) attached to the holder 51 and drive mechanism 52 therefor. Similarly, each of the cut pile hooks 47 (FIG. 2) includes a hooked front end or bill 58, with a body portion 59 that is received within the holder 51 of the drive mechanism 52. A knife or cutting blade 61 also generally is associated with each cut pile hook 47 and is supported by a drive mechanism 62 linked to the drive mechanism for the cut pile hooks, so as to be reciprocably driven into engagement with the cut pile hooks for cutting loops of yarns captured thereon to form the cut pile tufts 50.

Additionally, as indicated in FIG. 1B, the level cut loop loopers 48 also generally each include a hooked front end or bill 63, with each level cut loop looper further including an extensible clip 64 driven between engaging and non-engaging positions by actuators 66. A series of knives 61 likewise are associated with each of the level cut loop loopers so as to engage and cut loops of yarns collected thereon to selectively form cut pile tufts, when the clips are in their retracted positions. When the clips are in their extended engaging positions, such loops of yarns are enabled to be pulled off as needed to selectively form loop pile tufts.

FIG. 3 illustrates the operation of the yarn feed control system of the present invention 5 for forming a tufted patterned article having various pattern effects such as varying pile heights, tufts, etc. Each of the pattern steps or stitches to be run in the tufted pattern generally will be divided into stitch zones according to the pile height or yarn feed amount/density required therefor. The stitch zones generally can correspond to a portion or percentage of the tufting cycle for forming a selected stitch, such as a percentage or segment of the revolution of the main shaft. For example, each zone can correspond to 5-90% or more of the stitch cycle, or can correspond to 30°-90° or other segment of a 360° revolution of the main shift.

In an initial step 100, an operator will select a yarn feed zone for a selected pattern stitch or step for programming a first desired programmed yarn feed amount therefor. Thereafter, in a next step 101, the operator will input a yarn feed profile for the amount of yarn needed for the selected yarn feed zone of the selected stitch, either as a percentage of the total yarn feed for that stitch or step of the pattern, by weight or density, or by other measurement. For example, for each revolution of the main shaft, each stitch formed thereby can be divided into zones as a segment of the revolution of the main shaft, i.e., for two stitch zones, each zone can correspond to 50% of the revolution of the main shaft, with a desired portion of the total yarn feed amount for that stitch being assigned thereto.

If there are more than two zones of the pattern, the operator generally will select the next zone for input of a programmed yarn feed amount and thereafter will input the desired amount of yarn feed for such next selected zone, as indicated in step 102A. If there is not more than one additional yarn feed zone, as indicated at 102B, the system controller can automatically calculate and assign the remaining amount of the yarn feed for the selected stitch to be fed to the last yarn feed zone (step 103) for the selected stitch, or the operator can manually input a yarn feed profile or yarn feed amount as needed or desired. For example, the first yarn feed zone can correspond to the first half of a revolution cycle of the main shaft and can have 5-10% or more of the yarn feed for the stitch assigned thereto, with the remaining 90-95% or less, of the yarn feed assigned to the last half of the main shaft revolution. Conversely, the first yarn feed zone can be programmed to consume or feed a majority or significantly larger amount of yarn (i.e. 50-90% or more) in the first portion of a tufting or stitch cycle, i.e., in the first 10%-50% or 30°-180° of the revolution of the main shaft 50-90% of the total yarn feed amount for the selected stitch can be fed from the yarn feed device(s). This process can be repeated for additional stitches of the pattern, as indicated at step 104, or, alternatively, the programmed yarn feed profile (s) can be applied to all the stitches of the pattern or to a group of stitches of the pattern corresponding to a certain pattern field or area. Thereafter, the system will begin to tuft the programmed pattern (step 106).

As indicated at step 107, as the tufting machine begins to tuft the programmed pattern in the first zone selected, the yarns to be fed for that selected pattern yarn feed zone will be fed at the prescribed rate to supply the selected yarn feed percent or profile amount programmed/input for that particular zone. Once the first yarn feed zone is completed, the yarn feed rate or amount generally will be changed by the system controller to feed the yarn at the next prescribed rate as needed to supply the remainder of the yarn to the second (or last) tufting zone, as shown at step 108. Alternatively, if there are more yarn feed zones to be tufted (step 109), the yarn feed control can be varied as needed to feed the prescribed amount of yarn for each of the yarn feed zones until all the yarn feed zones are completed. Once all of the yarn feed zones of the programmed pattern step or stitch being run have been completed, the system controller returns to the yarn feed amount or rate for the first zone of the next pattern stitch and continues to tuft the additional yarn feed zones/stitches of the pattern until all of the steps of the pattern tuft run are complete, as indicated at step 110. Thereafter, once the pattern is completed, the system controller for the yarn feed control system of the present invention will halt further operation of the tufting machine as needed or desired, as shown in step 111.

The yarn feed control system of the present invention thus provides enhanced yarn feed profile control of the yarns to the needles of the tufting machine to enable the feeding of varying pile heights and other pattern effects per each stitch as needed at different areas or parts of the pattern being formed, and thus enables better control of the pile heights being run by feeding more/less yarns at more efficient or desired points during the tufting of the pattern steps. This further enables the yarn feed to be linked or run in conjunction with the backing feed such that, for example, when the backing is stopped, the yarn feed can be slowed or run at a lesser rate, while the yarn feed can be increased or a greater amount run while the backing material is being fed, or conversely, lesser amounts run as the backing is moving while greater amounts of yarns are fed while the backing is slowed or stopped, depending on pile heights to be run. Such control is especially helpful for the formation of synthetic tuft or grass fabrics or other, similar application, wherein a significant pile height differential, for example a low pile loop is being run with a higher cut pile or higher loop pile series of tufts. In addition, the yarn feed control system of the present invention enables greater control of the tension and thus slack in the yarn as being fed to the various needles, which can substantially eliminate the need for jerker bars that generally would be needed to take up the slack in the yarn feed of most conventional yarn feed systems. The yarn feed control system of the present invention further can be utilized with most conventional yarn feed type pattern attachments.

It will be further understood by those skilled in the art that while the present invention has been described above with reference to preferred embodiments, numerous variations, modifications, and additions can be made thereto without departing from the spirit and scope of the present invention as set forth in the following claims.

What is claimed:

1. A yarn feed control system for a tufting machine of the type having a series of needles carrying a plurality of yarns into a backing material passing through the tufting machine, the yarn feed control system comprising:

at least one yarn feed device including a series of motors and a series of yarn feed controllers for controlling operation of yarn feed motors;

backing feed rolls for feeding the backing material through the tufting machine at a desired rate; and a system controller in communication with the tufting machine for controlling operation of the tufting machine, and with said yarn feed controllers for controlling operation of said yarn feed motors as needed to feed desired amounts of yarns at selected locations of the backing material;

wherein said system controller is programmable with predetermined yarn feed profiles for selected yarn feed zones of selected stitches of a programmed pattern to be tufted, and can automatically feed yarns to selected needles for each stitch to be tufted according to said predetermined yarn feed profiles for said selected yarn feed zones of said selected stitches, and wherein each selected yarn feed zone of each selected stitch comprises a portion of at least one revolution of a main shaft of the tufting machine during which said selected stitch is formed.

2. The yarn feed control system of claim 1, and wherein said at least one yarn feed device is selected from the group comprising roll yarn feed attachments, scroll yarn feed attachments, single end yarn feed attachments, double end yarn feed attachments, and combinations thereof.

3. The yarn feed control system of claim 1, and further comprising a series of loopers adapted to engage the needles for forming loop pile tufts.

4. The yarn feed control system of claim 1, and further comprising a series of cut pile hooks adapted to engage the needles for forming cut pile tufts.

5. The yarn feed control system of claim 1, and further comprising a series of level cut loop loopers adapted to engage the needles for forming cut and loop pile tufts.

6. A method of forming a patterned tufted article, comprising:

selecting at least one yarn feed zone for a selected stitch of the pattern to be formed in the tufted article, the at least one yarn feed zone comprising a portion of at least one revolution of a main shaft of a tufting machine forming the patterned tufted article;

inputting a yarn feed amount for the selected yarn feed zone of the selected stitch;

assigning a yarn feed amount to a remaining yarn feed zone of the selected stitch;

tufting the patterned tufted article, comprising:

a) feeding yarns at the input yarn feed amount for the selected yarn feed zone of the selected stitch;

b) feeding yarns at the yarn feed amount for the remaining yarn feed zone of the selected stitch; and c) repeating steps a)-b) for each stitch of the pattern until the pattern is completed.

7. The method of claim 6, and wherein assigning a yarn feed amount to a remaining yarn feed zone comprises assigning a remainder of a total yarn feed amount to be fed for the selected stitch of the pattern to the remaining yarn feed zone.

8. The method of claim 6, and wherein the yarn feed amount input for the at least one selected yarn feed zone for the selected stitch comprises a percentage of a total yarn feed amount for the selected stitch of the pattern.

9. The method of claim 6, and wherein the yarn feed amount input for the at least one selected yarn feed zone for the selected stitch comprises an amount by weight of yarn.

10. The method of claim 6, and wherein the pattern comprises more than two yarn feed zones.

11. The method of claim 6, and wherein a system controller in which yarn feed amounts for the selected yarn feed zones are input automatically calculates a remaining yarn feed amount for the selected stitch of the pattern to be tufted and assigns the remaining yarn feed amount to a last yarn feed zone of the selected stitch.

12. The method of claim 6, and wherein the yarn feed zones of the selected stitch comprise different pile height tufts.

13. The method of claim 6, and wherein at least one selected yarn feed zone of the selected stitch comprises loop pile tufts and another yarn feed zone of the selected stitch comprises cut pile tufts.

14. The method of claim 6, and wherein each yarn feed zone comprises loop pile tufts and wherein the loop pile tufts of each yarn feed zone of the selected stitch are at different pile heights.

* * * * *